United States Patent [19]

Weaver et al.

[11] Patent Number: 4,782,955

[45] Date of Patent: Nov. 8, 1988

[54] BOTTLE CARRIER DEVICE

[75] Inventors: William N. Weaver, Northbrook; Mindaugas J. Klygis, Barrington, both of Ill.

[73] Assignee: Illinois Tool Works Inc., Chicago, Ill.

[21] Appl. No.: 909,860

[22] Filed: Sep. 22, 1986

[51] Int. Cl.[4] ..... B65D 71/00

[52] U.S. Cl. ..... 206/161; 206/150; 206/158; 206/162

[58] Field of Search ..... 206/145, 147, 150, 158, 206/161, 427, 428, 162; 294/87.2, 87.28

[56] References Cited

U.S. PATENT DOCUMENTS

| | | | |
|---|---|---|---|
| 2,989,177 | 6/1961 | Swick | 206/150 |
| 3,268,070 | 8/1986 | Cunningham | 206/150 |
| 3,269,530 | 8/1966 | Wanderer | 206/150 |
| 3,341,245 | 9/1967 | Wolford | 294/87.2 |
| 3,608,949 | 9/1971 | Owen | 294/87.2 |
| 3,727,754 | 4/1973 | Cunningham | 206/150 |
| 4,545,480 | 10/1985 | Klygis | 206/150 |
| 4,548,317 | 10/1985 | Weaver | 206/150 |
| 4,582,215 | 4/1986 | Barrash | 206/150 |

*Primary Examiner*—David T. Fidel

*Attorney, Agent, or Firm*—T. W. Buckman

[57] ABSTRACT

A bottle carrier device utilizing a single sheet-like resilient carrier device with a plurality of outer rank and middle rank apertures adapted to be positioned midway of the body of the bottles for individually grasping the bottles. The outer rank apertures are elongated longitudinally while the middle rank apertures are elongated transversely. A pair of handles are created in diagonally opposed outer rank apertures.

14 Claims, 1 Drawing Sheet

Fig. 1.
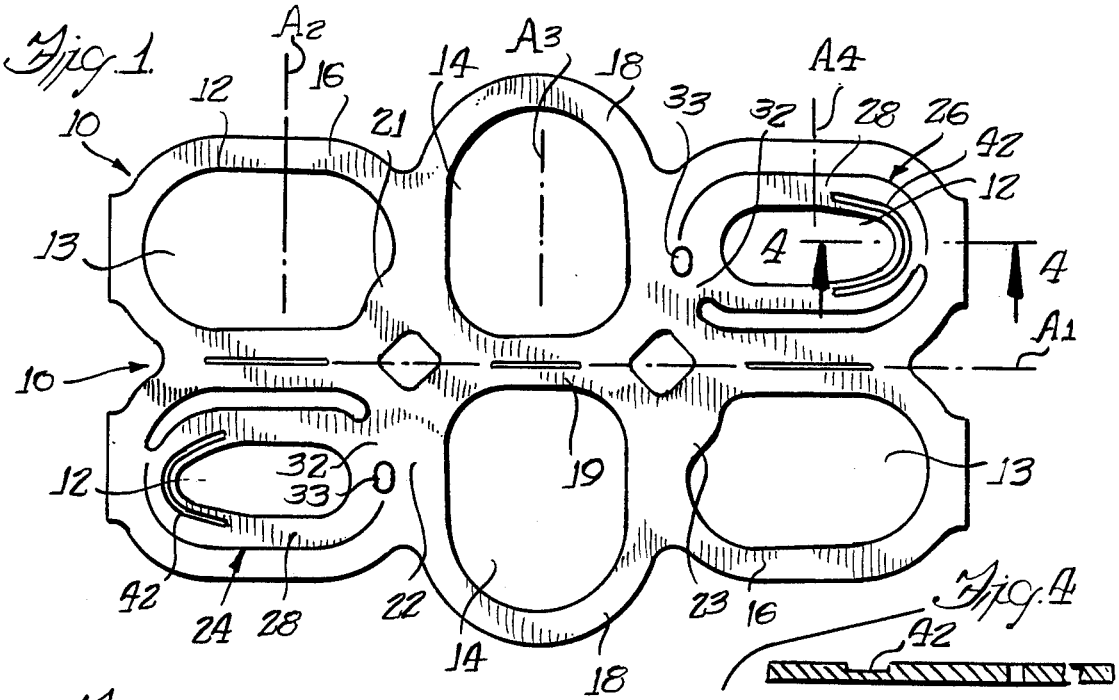
Fig. 4
Fig. 2.
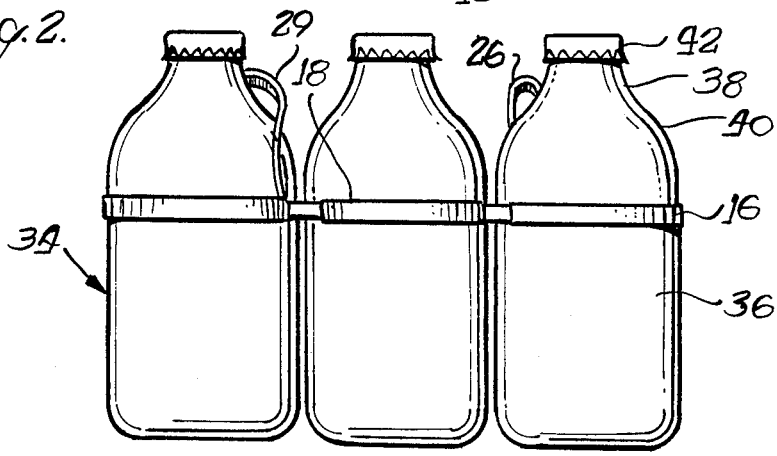
Fig. 3.
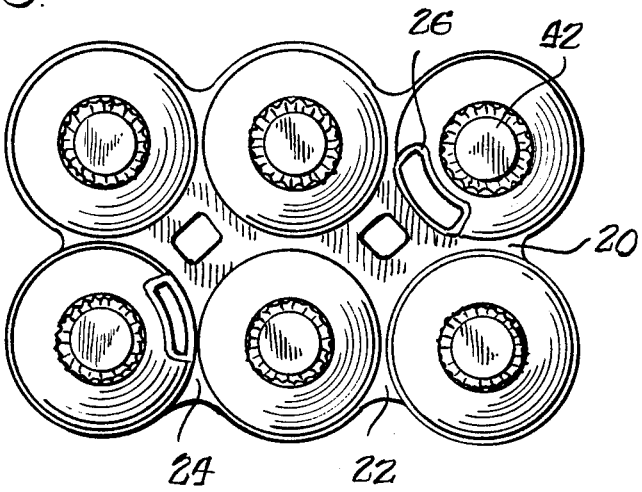

BOTTLE CARRIER DEVICE

BACKGROUND OF THE INVENTION

This invention relates generally to a bottle carrier device designed for packaging bottles of the conventional type including a generally cylindrical reduced neck portion diverging into a larger body portion. The neck portion has openings which may be closed by various caps or closure means. The bottles are typically arranged in a rank-and-row relationship usually in two parallel rows of three ranks.

Several efforts have been made to produce a carrier device for bottles or the like. Typical of such efforts are paperboard wrap-around or partial wrap-around carrier devices. Other efforts include a top-grouping carrier of plastic type material or cardboard material. Other packaging concepts utilized include a two-part device such as a band member around the periphery of the array in conjunction with a flexible resilient plastic member associated with and joining the neck of the bottle.

More recent efforts to create a carrier device for such bottles include a one-piece flexible plastic device such as generally described in U.S. Pat. Nos. 4,545,480; 4,548,317 and 4,557,375. The devices described in the aforementioned patents include a plurality of apertures equal in number to the bottles to be packaged, dimensioned to frictionally and resiliently grip the body regions of the bottles. The devices include handle means designed to extend upwardly of the plane of the device.

While these carrier devices represent an improvement over the prior art devices, the handle means have generally been limited in length making the handle means difficult for the user to grasp and hold.

OBJECTS AND SUMMARY OF THE INVENTION

The carrier device of the present invention is particularly designed for packaging bottles or the like in closely spaced ranks and rows. The package created by the device of this invention is a compact array of bottles which are unitized by a single resilient sheet-like device positioned generally midway of the body portion of each bottle. The device is particularly designed to include loop or handle means which extend upwardly from the plane of the location of the device on the bottles to a position which will provide a user or handler of such a package with a suitable handle means even though the device is situated directly adjacent the neck regions of the bottles. The device of this invention utilizes a single sheet of resilient plastic flexible material which includes a plurality of interconnected bands defining apertures equal in number to the bottles to be packaged, dimensioned to frictionally and resiliently grip the body regions of the bottle. The outer rank apertures in the device are uniquely extended longitudinally while the apertures in the middle rank of the device are extended transversely. This creates a carrier device which has a total length which is adaptable to the applicating machine. The handle means located in diagonally opposed outer rank apertures are similarly longitudinally extended to create larger handle means which are easier to grasp.

An object of the invention is thus to present a carrier device for bottles and the like which is positioned midway through the body portions of the containers while allowing a suitable finger-gripping or handle means.

An object of the present device is to provide a configuration of the flat carrier device which permits a handle means to be extended longitudinally which will provide a user or handler of such a package with a more suitable handle means.

A further object of the present invention is to provide a carrier of the above described type constructed so that inner edges of the interconnecting bands of the end apertures tighten the package in the lateral direction, while inner edges of the interconnecting bands of middle apertures tighten the package in the longitudinal direction, thereby creating a unitized package of standard length and width.

BRIEF DESCRIPTION OF THE DRAWINGS

The above and further objects of the invention will be apparent and fully pointed out in the detailed description and the accompanying drawings in which:

FIG. 1 is a plan view of the preferred embodiment of the carrier device of this invention;

FIG. 2 is a side view of a package comprising the carrier device of FIG. 1 and bottles or containers;

FIG. 3 is a top plan view of the carrier device; and

FIG. 4 is an enlarged fragmentary sectional view taken along lines 4—4 of FIG. 1.

DETAILED DESCRIPTION OF THE ILLUSTRATED EMBODIMENT

Referring now to FIG. 1, a carrier device 10, is shown and includes a plurality of outer or end apertures 12 and 13 and a plurality of middle apertures 14 arranged generally in ranks an rows. The carrier 10 is formed from a sheet of tough elastic plastic material. The apertures 12 and 13 are defined by annular band 16 and the apertures 14 are defined by annular band 18. These bands are integrally connected along longitudinally and laterally extending webs or junction lines 20 and 22. The band 16 has intermediate substantially straight section 17 extending longitudinally of the carrier 10 and the band 18 has intermediate substantially straight section 19 extending transversely of the carrier for the purpose described below. The carrier device 10 typically is provided with three lateral ranks of two longitudinal rows of apertures and bands, but can be made with any desired number of ranks and rows.

In order to more clearly define the orientation of the elements, the longitudinal axis is shown on FIG. 1 and is designated A1. A plurality of transverse or rank axes A2, A3 and A4 are also shown in FIG. 1 as bisecting each rank. It should be apparent that longitudinal web means 20 is situated on the longitudinal axis A1, and connects adjacent pairs of apertures in a given rank while lateral webs 22 connect adjacent pairs of apertures in a given row.

One aperture in each of the outer ranks includes handle means 24 and 26 integrally connected and emanating from the radially inner most quadrant thereof, between the longitudinal web means 20 and lateral web means 22. The handle means 24 and 26 are located in diagonally opposing outer rank apertures 12. It should be noted that the other pair of diagonally opposed outer rank apertures 13 have force compensating enlargements or webs 21 and 23 emanating from the radially inner most quadrant thereof at the junction between the longitudinal web means 20 and the lateral web means 22. The force compensating web members serve to stabilize stretching forces during assembly.

The handle means 24 and 26 are of oblong design and include a flat annular band means 28 which is connected to the margins of apertures 12 by hinge means 32 and a frangible strap connection 33. The frangible strap means tears easily so the handle means can bend around the hinge lines 32 as the carrier device is applied to the containers associated therewith.

As shown in FIG. 1, apertures 12 and 13 in the outer ranks are elongated in the direction of the longitudinal axis. The elongation of the apertures 12 and 13 allows longer handle means 24 and 26 to be created. The apertures 14 in the middle ranks are elongated in a transverse direction so that the total length of carrier device is substantially the same as the total length of the array of bottles that must be associated with the carrier device and the applicating machine. It should be noted that the outer rank apertures are substantially the same size and length, while the middle rank apertures are substantially the same size and length.

In assembly, the carrier device 10 is stretched over bottles 34 which have been placed in a close array defined by rows and ranks. The bottles 34 include a body 36 joined to a neck portion 38 of greatly reduced diameter by a transitional shoulder means 40. The neck region includes an opening which is sealed by conventional cap means 42. The carrier device 10 is forced downwardly until it is positioned about midway of the body portion 36 of the bottles 34 to provide the necessary frictional holding power and holding stability for the package. As the carrier device is stretched over the bottles 34 the straight sections 17 of the band 16 create a stretch which tends to tighten the package in the lateral direction and the straight sections of the band 18 tend to tighten the package in the longitudinal direction, thereby creating a tight package. As the carrier device 10 is forced downwardly over the bottles 34, suitable means not shown, enable the handle means 24 and 26 to be pushed up out of the diagonally opposed outer rank apertures 12 and 13 and into an upright position as shown in FIGS. 2 and 3. The frangible strap means 33 tears easily in assembly allowing the handle means 24 and 26 to bend around the hinge means 32.

As shown in FIG. 4 the surface of handle means 24 and 26 opposite said hinge lines 32 are coined to form grooves or fold line 42. The grooves or fold lines 42 enable the inner margin of the handle means 24 and 26 to fold over to provide a double thickness for easier use.

While a particular embodiment of the invention has been shown and described, it will be obvious to those skilled in the art that changes and modifications of the present invention, in its various aspects, may be made without departing from the invention in its broader aspects. As such, the scope of the invention should not be limited by the particular embodiment and specific construction described herein but should be defined in the appended claims and equivalents thereof.

The invention is claimed as follows:

1. A carrier device for unitizing a plurality of containers having a cylindrical body region and reduced diameter neck portion, the carrier device being formed from a resilient elastic deformable sheet of plastic material and comprising a plurality of integrally connected bands defining ranks and rows of apertures disposed along a longitudinal axis and equal in number to said plurality of containers, the rows being situated on opposite sides of said longitudinal axis, and the said ranks being disposed transversely to said longitudinal axis, the apertures in at least one rank being elongated in the direction of said longitudinal axis and the apertures in another rank being elongated transversely of said longitudinal axis, the bands creating the apertures being configured so that the lateral outermost regions of the bands and associated apertures of the transversely elongated apertures extend laterally beyond the lateral outermost regions of the bands and associated apertures of the longitudinally elongated apertures, and handle means extending from an inner margin of at least one of said longitudinally elongated apertures wherein the total length of said carrier device is substantially the same as the array of containers associated therewith in assembly.

2. A carrier device of claim 1 wherein said handle means is oblong and comprises a flat annular band which is connected to an inner most quadrant of a margin of said longitudinally elongated aperture by hinge means and to a spaced portion of said margin by a frangible strap connection.

3. A carrier device of claim 1 wherein a force compensating web extends from an inner margin of said longitudinally elongated apertures adjacent to said longitudinally elongated aperture including said handle means.

4. A carrier device of claim 1 wherein said integrally connected bands defining the longitudinally elongated apertures have an intermediate substantially straight section extending along the longitudinal axis and said integrally connecting bands defining the transversely elongated apertures have an intermediate substantially straight section extending transversely of said longitudinal axis.

5. The carrier device of claim 1 wherein the longitudinally elongated rank apertures are substantially identical in size and shape.

6. The carrier device of claim 1 wherein the transversely elongated rank apertures are substantially identical in size and shape.

7. The carrier device of claim 2 wherein a curved portion of the handle means opposite from said hinge means is coined defining a fold line.

8. A carrier device for unitizing a plurality of containers having a cylindrical body region and reduced diameter neck portion, the carrier device being formed from a resilient elastic deformable sheet of plastic material and comprising a plurality of integrally connected annular bands defining ranks and rows of apertures disposed along a longitudinal axis, the rows being situated on opposite sides of said longitudinal axis, and said ranks being transversely disposed to said longitudinal axis, lateral web means integrally connecting adjacent bands of pairs of said apertures in a given row, each aperture being elongated to define different dimensions in the longitudinal axis direction and in the direction transverse the longitudinal axis outer rank apertures being elongated in the direction of said longitudinal axis and middle rank apertures being elongated transversely of said longitudinal axis, said integrally connected bands defining the longitudinally elongated apertures have an intermediate substantially straight section extending along said longitudinal axis and said integrally connecting bands defining the transversely elongated apertures have on intermediate substantially straight section extending transversely of said longitudinal axis and a pair of handle means extending from an inner margin of diagonally opposed longitudinally elongated apertures.

9. A carrier device of claim 8 wherein said handle means are oblong and comprises a flat annular band which is connected to a margin of diagonally opposed outer rank aperture by hinge means and to a spaced portion of said margin by a frangible strap connection.

10. A carrier device of claim 8 wherein a force compensating web extends from an inner margin of a pair of diagonally opposed longitudinally elongated apertures adjacent to said diagonally opposed longitudinally elongated apertures including said handle means.

11. A carrier device of claim 8 wherein the total length of said carrier device is substantially the same as the array of containers associated therewith in assembly.

12. The carrier device of claim 8 wherein the longitudinally elongated rank apertures are substantially identical in size and shape.

13. The carrier device of claim 8 wherein the transversely elongated rank apertures are substantially identical in size and shape.

14. A carrier device of claim 9 wherein a curved portion of the handle means opposite from said hinge means is coined defining a fold line.

* * * * *